US007669565B2

(12) United States Patent
Pass

(10) Patent No.: US 7,669,565 B2
(45) Date of Patent: Mar. 2, 2010

(54) OIL FEED SYSTEM FOR A HYDRAULICALLY ACTUATED CAM PHASER

(75) Inventor: Stephen B. Pass, Utica, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 490 days.

(21) Appl. No.: 11/734,882

(22) Filed: Apr. 13, 2007

(65) Prior Publication Data

US 2008/0251045 A1 Oct. 16, 2008

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

2005/0066924 A1* 3/2005 Lehmann et al. ..... 123/90.17

* cited by examiner

*Primary Examiner*—Zelalem Eshete

(57) ABSTRACT

An internal combustion engine is provided having an engine block defining a pressurized oil source and rotatably supporting a crankshaft. A camshaft is rotatably mounted within the engine block and defines an axially extending cavity. The cavity extends between opposed first and second ends of the camshaft. A cam phaser is mounted to the second end of the camshaft and is operable to vary the timing of the camshaft with respect to the crankshaft in response to pressurized oil. A cover is removably mounted to the engine block and is operable to substantially enclose the first end of the camshaft. The cover at least partially defines a passage in communication with the pressurized oil source and cavity. The passage and the cavity are operable to communicate pressurized oil from the pressurized oil source to the cam phaser to actuate the cam phaser.

19 Claims, 3 Drawing Sheets

OIL FEED SYSTEM FOR A HYDRAULICALLY ACTUATED CAM PHASER

TECHNICAL FIELD

The present invention relates to an oil feed system operable to communicate pressurized oil to a hydraulically actuated cam phaser.

BACKGROUND OF THE INVENTION

A cam phaser is a device operable to selectively create a variable rotational offset between a camshaft and a crankshaft of an internal combustion engine. The degree of rotational offset created by the cam phaser enables the operating characteristics of the internal combustion engine to be tuned for specific performance requirements. The operation of the cam phaser is typically facilitated by providing pressurized oil to the cam phaser.

SUMMARY OF THE INVENTION

An internal combustion engine is provided having an engine block with a pressurized oil source and rotatably supporting a crankshaft. The internal combustion engine includes a camshaft rotatably mounted within the engine block and defines an axially extending cavity. The axially extending cavity extends between opposed first and second ends of the camshaft. A selectively actuatable cam phaser is mounted to the second end of the camshaft and is operable to vary the timing of the camshaft with respect to the crankshaft in response to pressurized oil. A cover is removably mounted to the engine block and is operable to substantially enclose the first end of the camshaft. The cover at least partially defines a passage in communication with the pressurized oil source, defined by the engine block, and the axially extending cavity, defined by the camshaft. The passage and the axially extending cavity are operable to communicate pressurized oil from the pressurized oil source to the cam phaser to actuate the cam phaser.

The cover may be mounted to the engine block via a plurality of fasteners. Preferably, the cover is sealed with respect to the engine block. A portion of the cam phaser may be at least partially housed within the axially extending cavity. The portion defines a cam phaser feed passage operable to communicate pressurized oil from the axially extending cavity defined by the camshaft to the cam phaser.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
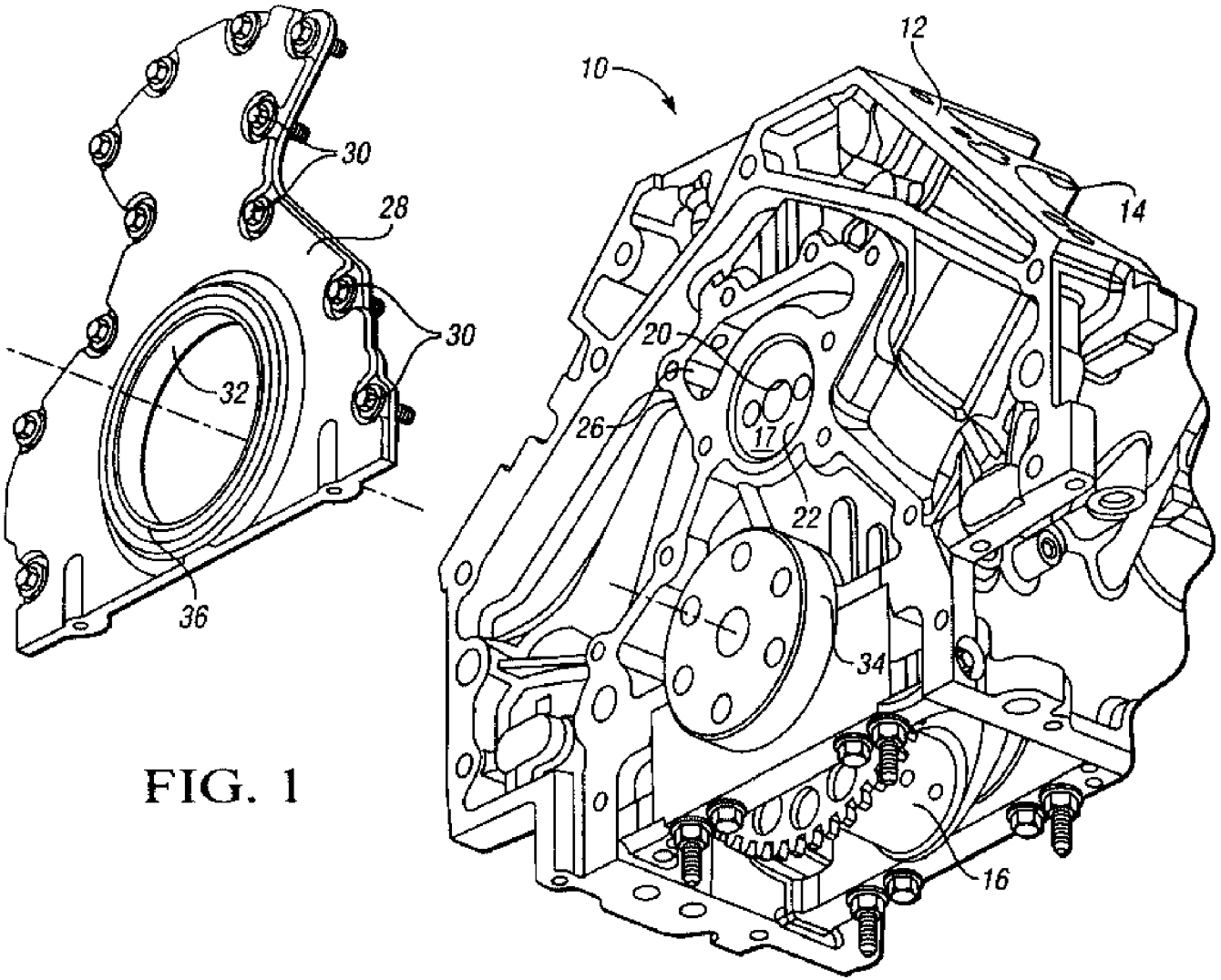
FIG. 1 is a exploded view of a portion of an internal combustion engine illustrating an engine block having a cover mountable thereto.

Referring to the drawings wherein like reference numbers correspond to like or similar components throughout the several figures, there is shown in FIG. 1 a portion of an internal combustion engine, generally indicated at 10. The internal combustion engine 10 includes a cylinder block or engine block 12 defining at least one cylinder 14 within which a piston, not shown, is reciprocally movable. A crankshaft 16 is rotatably supported by the engine block 12 and is operatively connected to a camshaft 17 through a cam drive assembly 18, shown in FIG. 3, to effect rotation of the camshaft 17. The camshaft 17 is rotatably supported within the engine bock 12 and is operable to selectively open and close intake and exhaust valves, not shown, during the operation of the internal combustion engine 10. The camshaft 17 defines a hollow passageway or cavity 20. The cavity 20 extends generally axially along the entire length of the camshaft 17 between a first end 22 and an opposed second end 24, shown in FIG. 3.

The engine block 12 is preferably cast from a metal, such as cast iron or aluminum, and includes a pressurized oil source 26. The pressurized oil source 26 is configured to communicate pressurized oil to lifter galleries to enable operation of hydraulic lash adjusters or lifters, not shown. A cover 28 is configured to be removably mounted to the engine block 12 by a plurality of fasteners 30. The cover 28 is operable to substantially enclose the pressurized oil source 26 and the first end 22 of the camshaft 17. The cover 28 sealingly engages the engine block 12. Those skilled in the art will recognize suitable means of sealing the cover 28 to the engine block 12 such as, for example, room temperature vulcanization (RTV) sealant, gasket, etc.

The cover 28 defines a bore 32 configured to receive a generally cylindrical portion 34 of the crankshaft 16 therethrough. A lip seal 36 is provided within the bore 32 and is operable to sealingly engage the portion 34 of the crankshaft 16. The lip seal 36 is operable to prevent foreign material from entering the internal combustion engine 10 through the cover 28 to crankshaft 16 interface. Additionally, the lip seal 36 is operable to prevent the external leakage of oil from within the internal combustion engine 10.

Figure 2:
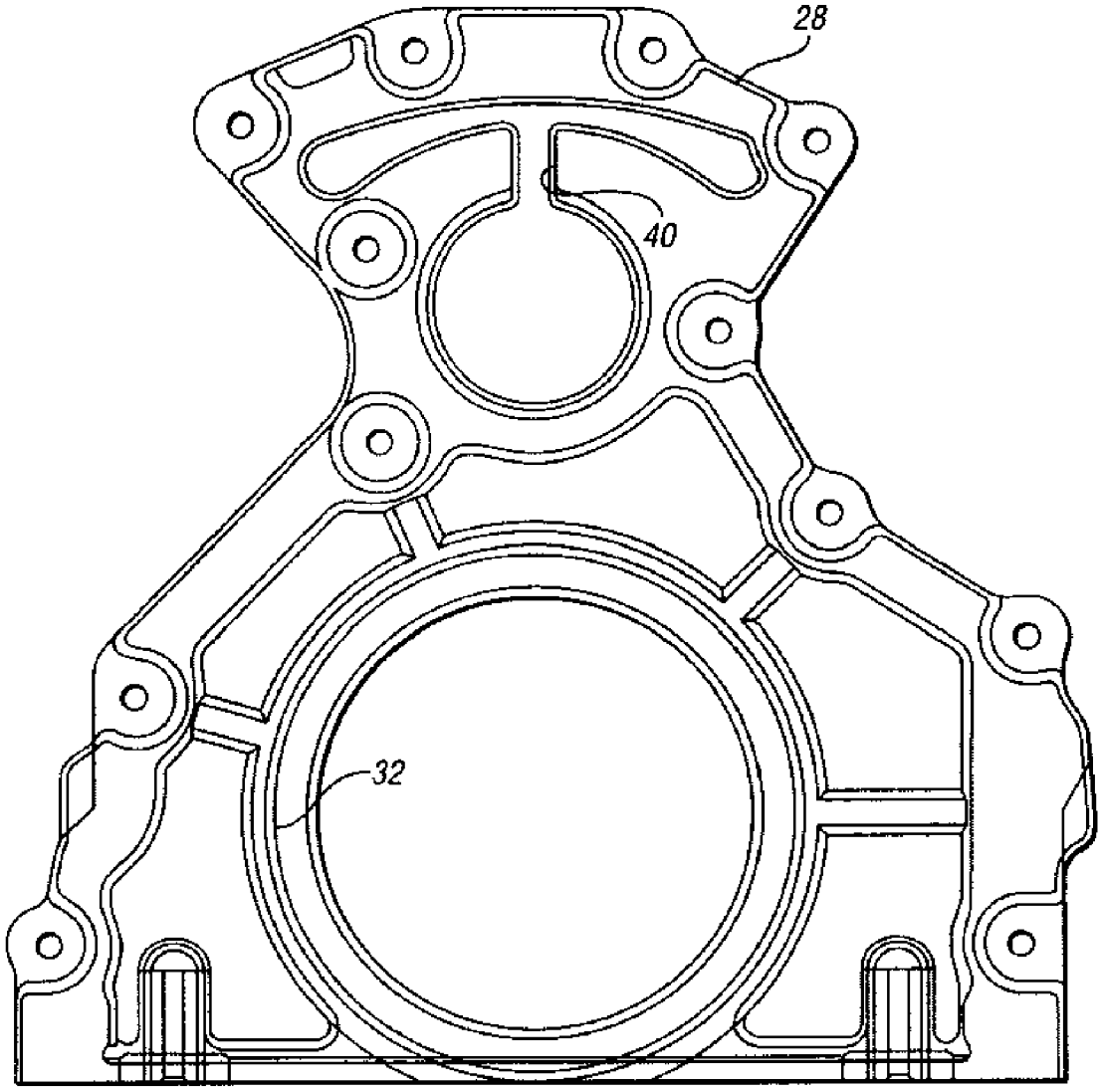
FIG. 2 is a front view of the cover of FIG. 1 illustrating a passage partially defined therein.

Referring to FIG. 2, and with continued reference to FIG. 1, there is shown a front view of the cover 28, i.e. the side of the cover 28 that engages the engine block 12 when mounted thereto. The cover 28 at least partially defines a passage 40 that, when the cover 28 is installed on the engine block 12, is in communication with pressurized oil source 26 and the cavity 20. Therefore, pressurized oil contained within the pressurized oil source 26 is communicated directly to the cavity 20 via the passage 40. The engine block 12 may partially define the passage 40 while remaining within the scope of that which is claimed herein.

Figure 3:
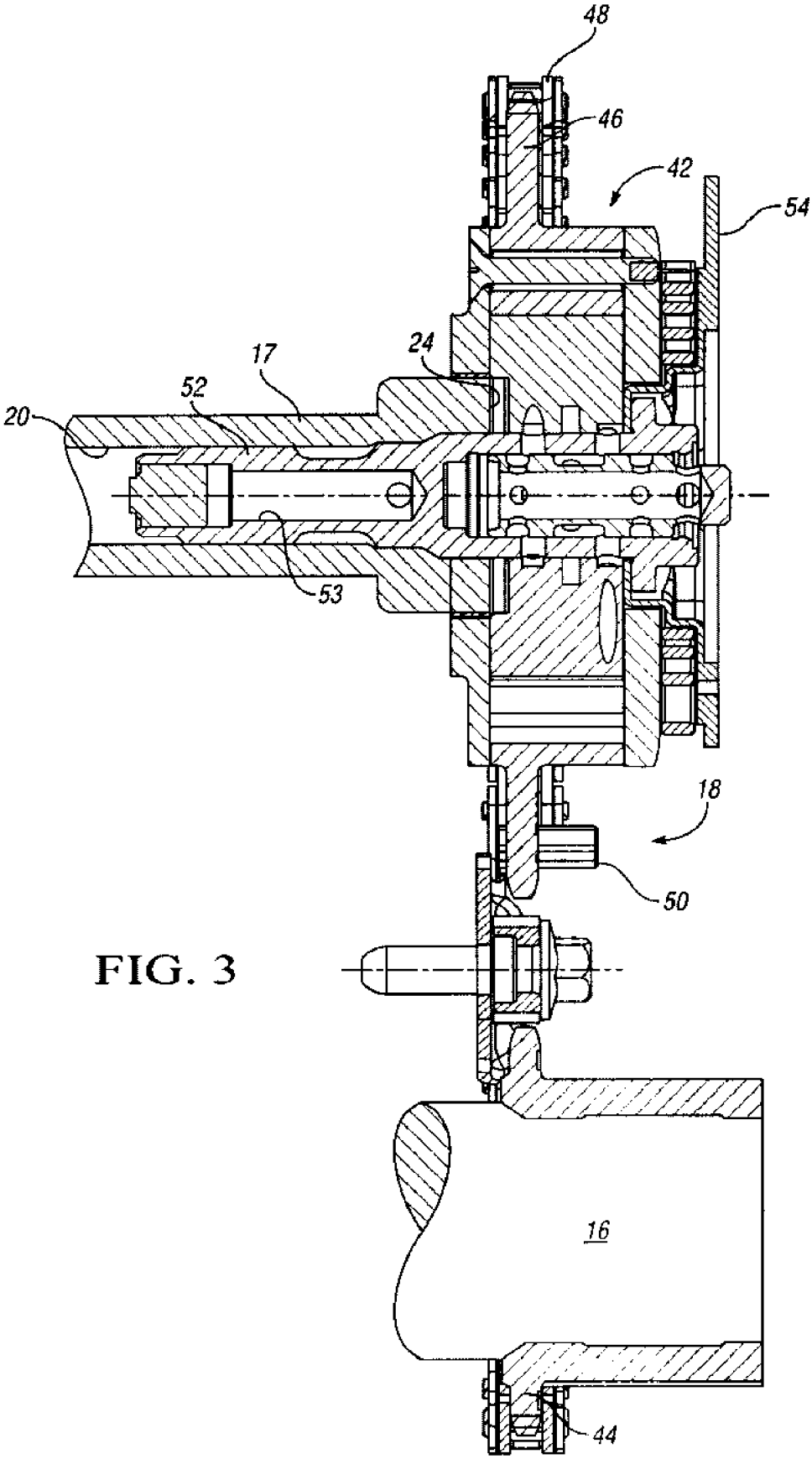
FIG. 3 is a cross sectional view of a cam phaser mounted to a camshaft of the internal combustion engine, shown in FIG. 1.

Referring to FIG. 3, and with continued reference to FIGS. 1 and 2, there is shown a cam phaser assembly 42 mounted to the second end 24 of the camshaft 17 and configured to be driven by the crankshaft 16 through the cam drive assembly 18. The cam drive assembly 18 includes a crankshaft sprocket 44, mounted to the crankshaft 16, and a camshaft sprocket 46, mounted to the cam phaser assembly 42. The crankshaft sprocket 44 is drivingly connected to the camshaft sprocket 46 by a timing chain 48. Those skilled in the art will recognize other methods of providing drive force between the crankshaft 16 and the cam phaser assembly 42 such as, for example, a gear drive. The cam drive assembly 18 further includes a tensioner or snubber 50 operable to tension and stabilize the timing chain 48 during operation of the internal combustion engine 10.

The cam phaser assembly 42 is hydraulically actuated and includes a valve body 52 that extends at least partially into the cavity 20 defined by the camshaft 17. The valve body 52 is operable to selectively and variably communicate pressurized oil from within the cavity 20 to the cam phaser 42 to effect actuation thereof. In operation, pressurized oil is communicated from the pressurized oil source 26 to the cavity 20 via the passage 40. The cavity 20 communicates the pressurized oil the entire length of the camshaft 17 to the valve body 52. The valve body 52 defines a cam phaser feed passage 53 operable to communicate pressurized oil from the cavity 20 to the cam phaser assembly 42. The valve body 52, in response to control signals, selectively and variably actuates the cam phaser assembly 42 to vary the rotational offset or timing of the camshaft 17 with respect to the crankshaft 16. A target wheel 54 is mounted to the cam phaser assembly 42 and cooperates with a sensor, not shown, to communicate the position, i.e. advanced or retarded, of the camshaft 17.

While the internal combustion engine 10 illustrated in FIG. 1 is shown having only one camshaft 17, those skilled in the art will recognize that additional camshafts 17 may be provided while remaining within the scope of that which is claimed. By providing a main or priority pressurized oil supply circuit to the cam phaser 42, performance of the cam phaser 42 may be improved since pressurized oil provided to the cam phaser 42 is not significantly affected by leakage within other components of the internal combustion engine 10, nor is it significantly affected by engine speed.

While the best modes for carrying out the invention have been described in detail, those familiar with the art to which this invention relates will recognize various alternative designs and embodiments for practicing the invention within the scope of the appended claims.

The invention claimed is:

1. An internal combustion engine having an engine block including a pressurized oil source and rotatably supporting a crankshaft, the internal combustion engine comprising:

a camshaft rotatably mounted within the engine block and defining an axially extending cavity;

wherein said axially extending cavity extends between opposed first and second ends of said camshaft;

a selectively actuatable cam phaser mounted to said second end of said camshaft and operable to vary the timing of said camshaft with respect to the crankshaft in response to pressurized oil;

a cover removably mounted to the engine block and operable to substantially enclose said first end of said camshaft; and wherein said cover at least partially defines a passage in communication with the pressurized oil source defined by the engine block and said axially extending cavity defined by said camshaft, said passage and said axially extending cavity being operable to communicate pressurized oil from the pressurized oil source to said cam phaser to actuate said cam phaser.

2. The internal combustion engine of claim 1, wherein said cover is sealed with respect to said engine block.

3. The internal combustion engine of claim 1, wherein said cover is removably mounted to the engine block by a plurality of fasteners.

4. The internal combustion engine of claim 1, wherein said passage is partially defined by the engine block.

5. The internal combustion engine of claim 1, wherein a portion of said cam phaser is at least partially housed within said axially extending cavity, said portion defining a cam phaser feed passage operable to communicate pressurized oil from said axially extending cavity defined by said camshaft to said cam phaser.

6. The internal combustion engine of claim 1, further comprising a seal member mounted within said cover and operable to sealingly engage the crankshaft.

7. The internal combustion engine of claim 6, wherein said seal member is a lip seal.

8. The internal combustion engine of claim 1, wherein said cover is formed from one of aluminum and plastic.

9. An internal combustion engine having a source of pressurized oil and a rotatable crankshaft, the internal combustion engine comprising:

a camshaft rotatably mounted within the engine and defining an axially extending cavity;

wherein said axially extending cavity extends between opposed first and second ends of said camshaft;

a selectively actuatable cam phaser mounted to said second end of said camshaft and operable to vary the timing of said camshaft with respect to the crankshaft in response to pressurized oil;

a cover removably mounted to the engine and operable to substantially enclose said first end of said camshaft; and wherein said cover at least partially defines a passage in communication with the source of pressurized oil and said axially extending cavity defined by said camshaft, said passage and said axially extending cavity being operable to communicate pressurized oil from the source of pressurized oil to said cam phaser to actuate said cam phaser.

10. The internal combustion engine of claim 9, further comprising an engine block operable to rotatably support said camshaft.

11. The internal combustion engine of claim 10, wherein said cover is removably mounted to said engine block.

12. The internal combustion engine of claim 11, wherein said cover is sealed with respect to said engine block.

13. The internal combustion engine of claim 10, wherein said passage is partially defined by the engine block.

14. The internal combustion engine of claim 9, wherein a portion of said cam phaser is at least partially housed within said axially extending cavity, said portion defining a cam phaser feed passage operable to communicate pressurized oil from said axially extending cavity defined by said camshaft to said cam phaser.

15. The internal combustion engine of claim 9, further comprising a seal member mounted within said cover and operable to sealingly engage the crankshaft.

16. An internal combustion engine comprising:

an engine block having a pressurized oil source;

a crank shaft rotatably supported by said engine block;

a camshaft rotatably mounted within the engine block and defining an axially extending cavity;

wherein said axially extending cavity extends between opposed first and second ends of said camshaft;

a selectively actuatable cam phaser mounted to said second end of said camshaft and operable to vary the timing of said camshaft with respect to the crankshaft in response to pressurized oil;

a cover removably mounted to the engine block and operable to substantially enclose said first end of said camshaft;

wherein said cover at least partially defines a passage in communication with the pressurized oil source defined by the engine block and said axially extending cavity defined by said camshaft, said passage and said axially extending cavity being operable to communicate pressurized oil from the pressurized oil source to said cam phaser; and wherein a portion of said cam phaser is at least partially housed within said axially extending cavity, said portion defining a cam phaser feed passage operable to communicate pressurized oil from said axially extending cavity defined by said camshaft to said cam phaser.

17. The internal combustion engine of claim 16, wherein said cover is sealed with respect to said engine block.

18. The internal combustion engine of claim 16, wherein said passage is partially defined by the engine block.

19. The internal combustion engine of claim 16, further comprising a seal member mounted within said cover and operable to sealingly engage the crankshaft.

* * * * *